United States Patent [19]

Stanescu et al.

[11] Patent Number: 4,648,914

[45] Date of Patent: Mar. 10, 1987

[54] PROCESS FOR ANNEALING FERROUS WIRE

[75] Inventors: Mircea S. Stanescu, Pluckemin; David J. Weinstein, Livingston; Cornelius W. Cornelssen, Edison, all of N.J.

[73] Assignee: The BOC Group, Inc., Montvale, N.J.

[21] Appl. No.: 662,855

[22] Filed: Oct. 19, 1984

[51] Int. Cl.[4] ..... C21D 1/26

[52] U.S. Cl. ..... 148/16; 148/16.6

[58] Field of Search ..... 148/16, 16.6, 16.7, 148/20.3, 13.1, 14; 134/14, 20

[56] References Cited

U.S. PATENT DOCUMENTS

| | | | |
|---|---|---|---|
| 3,966,509 | 6/1976 | Podgurski | 148/16 |
| 4,016,011 | 4/1977 | Asai | 148/16 |
| 4,359,351 | 11/1982 | Levis | 148/16.7 |
| 4,461,656 | 7/1984 | Ross | 148/16.6 |

FOREIGN PATENT DOCUMENTS

| | | | |
|---|---|---|---|
| 1136358 | 9/1962 | Fed. Rep. of Germany | 148/16.7 |
| 80713 | 5/1984 | Japan | 148/16.7 |

*Primary Examiner*—Christopher W. Brody

*Attorney, Agent, or Firm*—David A. Draegert; Larry R. Cassett

[57] ABSTRACT

Soot deposition from protective atmospheres and residual lubricants normally carried on ferrous wire and removed during annealing. During the cooling stage of an annealing cycle, air or other suitable oxygen containing gas is introduced into an annealing furnace containing the wire when the wire temperature is between approximately 1050° and 950° F. At these temperatures, the introduced oxygen is effective to volatilize the residual lubricant and soot formed from decomposition of carbon monoxide. This removal is accomplished without significant decarburization of the wire and only minor oxidation thereof. The oxygen containing gas may be introduced into a bell furnace by raising the inner cover thereof or the oxygen containing gas may be injected into the inner retort of a bell furnace or directly into a batch furnace.

9 Claims, 1 Drawing Figure

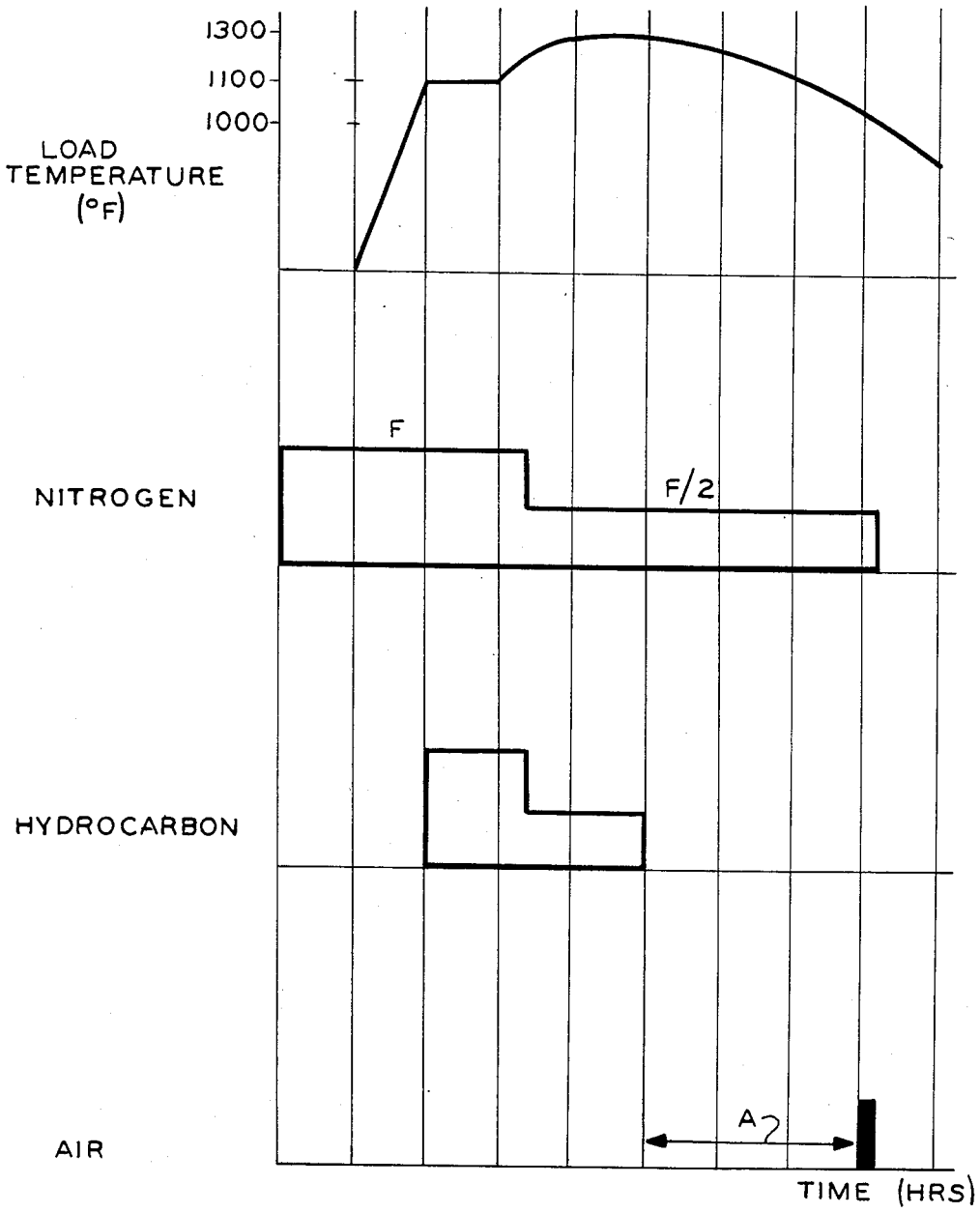
1300
1100
1000
LOAD TEMPERATURE (°F)
F
F/2
NITROGEN
HYDROCARBON
A?
AIR
TIME (HRS)

PROCESS FOR ANNEALING FERROUS WIRE

BACKGROUND OF THE INVENTION

The present invention relates to improved methods for annealing ferrous wire and more particularly, to improved methods for removing residual lubricants and soot formed during such annealing.

Steel wire is commonly formed by drawing through a series of dies. This drawing operation is facilitated by lubricating the wire, typically with a soap powder or other organic material. Although ferrous wire is generally annealed with residual lubricants thereon, it is necessary but quite difficult to remove such residual lubricants and soot that may be deposited on the wire during annealing. The difficulty in removing lubricants occurs from the fact that at excessive heat rates, it is difficult to readily evacuate such lubricants from the annealing furnace before cracking the lubricants. In addition, as carbon monoxide in the furnace atmosphere tends to decompose into free carbon and carbon dioxide upon cooling down from the annealing temperatures, annealed wire frequently exhibits a significant soot deposit. It has been common practice to remove resulting lubricants and soot subsequent to annealing by dipping ferrous wire, typically in large rolls from 2,000 to 20,000 lbs. each into an acidic or caustic cleaning bath. This, however, involves the consumption of considerable quantities of acid and caustic materials and the disposal of such materials when spent. In addition, labor and maintenance costs are also involved in these operations.

It is known to anneal ferrous wire under nitrogen based atmospheres as, for example, is described in an article entitled "Annealing Ferrous Wires in Nitrogen Based Atmospheres," Wire Journal International, 1983, Pages 52–55. The problems caused by contaminants in such atmospheres, such as $CO_2$, moisture, etc. are ostensibly alleviated by introducing an additive such as hydrocarbons and/or methanol to enable the carbon potential of such atmospheres to be controlled. Most of the lubricant is evacuated from the furnace before lubricant cracking can occur. However, some residual, cracked lubricant and soot will remain on the wire upon completion of annealing. This article, however, indicates that the cooling time of a process described therein may be reduced by opening a furnace to air at a temperature of 600° F. or lower or below 800° F. if bluing, i.e. oxidation, may be tolerated. In addition, U.S. Pat. No. 4,016,011 indicates that air cooling of ferrous parts being heat treated under a nitrogen based atmosphere may be achieved as long as the temperature of such parts is below 800° F. The problem of lubricant and soot removal is not addressed, however, in this reference.

It is also known to attempt to prevent soot formation in heat treating processes such as brazing by adding oxidants such as air, moisture, etc. into a furnace as temperature builds up. Such a process is described in an article entitled "Humidifying Furnace Atmospheres Can Prevent Soot Formation," Heat Treating, April, 1982, Pages 32 and 34–36. It is noted that soot and other residues can be formed from a reaction between the furnace atmosphere and brazing paste components, and in order to avoid leaving such residues, it is proposed to modify such paste and add air to the front end of a continuous furnace, but at a temperature greater than 1400° F. to avoid explosive conditions developing in the furnace. Although this technique may be successful in certain brazing processes practiced in continuous furnaces, the same is not believed to be effective in an enclosed bell or batch furnace where vaporized contaminants, $CO_2$, etc. will remain and decarburize ferrous parts at furnace temperatures in excess of 1100° F.

U.S. Pat. No. 4,359,351 describes a process for annealing ferrous metals under protective atmospheres wherein nitrogen and methanol are utilized. Although this process may be generally satisfactory to anneal such metals, soot formation results as is described in the examples of this patent. Thus, previously known processes for annealing ferrous wire have not been successful to achieve such annealing under nitrogen based atmospheres without significant soot formation and resulting lubricant residues. In fact, lubricant removal is generally so incomplete that annealed ferrous wire must generally be dipped in a cleaning bath following annealing under nitrogen based atmospheres as generally described hereinabove.

Thus, there is a clear need for processes for annealing ferrous wire wherein lubricant removal readily occurs and soot formation is essentially precluded prior to the removal of wire from the furnace to thereby avoid the requirement to dip such wire in a cleaning bath or the like.

OBJECTS OF THE INVENTION

It is an object of the present invention to provide an improved process for annealing ferrous wire.

It is another object of the present invention to provide an improved process for annealing ferrous wire wherein residual lubricants thereon are removed during annealing.

It is still another object of the present invention to provide processes for annealing ferrous wire without significant soot deposits remaining thereon.

It is yet another object of the present invention to provide improved processes for annealing ferrous wire which do not require the use of cleaning baths in order to remove lubricants and soot subsequent to such annealing.

It is still a further object of the present invention to provide improved processes for annealing ferrous wire to obtain a clean wire product.

Other objects of the invention will become apparent from the following description of exemplary embodiments thereof which follows and the novel features will be particularly pointed out in conjunction with the claims appended hereto.

SUMMARY

In accordance with the invention, a process for annealing ferrous wire with residual lubricants thereon in a furnace under a nitrogen based atmosphere comprises the steps of heating the wire to an annealing temperature of about 1320° F., soaking such wire under said temperature, reducing said temperature to cool the wire over a predetermined time period, and introducing an oxygen containing gas into said furnace upon the wire, i.e. load temperature decreasing to about 1050°–950° F. to volatilize said lubricants without significantly decarburizing said wire or forming substantial amounts of soot thereon. Nitrogen is initially introduced into the furnace slightly before commencement of heating the same, and this nitrogen flow is initially maintained at a relatively high flow rate to purge the furnace of evaporated lubricants, oxidants, decarburizing agents, etc. such as oxygen, moisture and $CO_2$. Preferably, a minor amount of a hydrocarbon such as methane, propane, etc. is introduced into the annealing furnace after the initial purging thereof with nitrogen, and when the furnace has reached a temperature of at least 1100° F. Upon the load reaching an annealing temperature of about 1320° F., the initial nitrogen flow may be reduced to about one-half thereof and similarly, the flow of hydrocarbons is also, preferably reduced in a similar manner at such time. Following a "soaking" period of the ferrous wire under the aforementioned annealing temperature, the latter is reduced in a cooling stage, although the flow of nitrogen to the furnace is continued to assure a positive pressure in the furnace and that impurities are removed from the furnace atmosphere. When the wire temperature is reduced to approximately 1050°-950° F., an oxygen containing gas such as air or other oxygen-nitrogen mixture is introduced into the furnace. At this temperature, the added oxygen will effectively react with the residual lubricants and soot deposits. The gaseous reaction products such as CO, $CO_2$, $H_2O$, etc. will be evacuatged from the furnace. Also, the oxygen will react with free carbon which otherwise is deposited as soot as carbon monoxide in the furnace atmosphere undergoes a decomposition below 1100° F. Thus, relatively little free carbon remains on the wire as soot upon completion of the cooling stage and a "clean", but mildly oxidized annealed wire relatively free of lubricants, may be removed from the furnace upon further cooling to about 900° F. or so.

The oxygen containing gas may be introduced into a bell furnace by raising the inner retort or cover thereof for a predetermined period of time or such gas may be injected through a suitable valved conduit arrangement at a controlled rate into the inner retort of a bell furnace or directly into a batch furnace. The flow of oxygen containing gas into the furnace is terminated after a predetermined time by lowering such inner cover or retort or terminating injection of the gas flow into a batch furnace. When the wire temperature is reduced to below about 950° F., insufficient reactivity occurs between the introduced oxygen and any remaining lubricants and by so terminating the flow of this gas, extensive oxidation of the ferrous wire will be avoided.

Consequently, by subjecting ferrous wire to an oxygen containing gas during annealing thereof at the temperature range mentioned above, difficult to remove lubricants will be volatilized without any significant soot formation. Thus, in annealing ferrous wire in accordance with the invention, the requirement of a cleaning bath or other similar step subsequent to the annealing process is simply not required.

BRIEF DESCRIPTION OF THE DRAWING

The invention will be more clearly understood by reference to the following description of an exemplary embodiment thereof in conjunction with the following drawing in which the sole FIGUREis a graphical representation of exemplary parameters of the annealing process according to the invention.

DESCRIPTION OF PREFERRED EMBODIMENT

In accordance with the invention, ferrous wire is annealed under appropriate temperatures so that the wire exhibits a "clean" finish. It will bé understood that a "clean" finish is one which exhibits some discoloration from oxides thereon as compared to a "bright" finish which is formed by the use of reducing atmospheres. Typically, hydrogen-nitrogen mixtures or disassociated ammonia are employed to provide ferrous materials with a bright finish. Frequently, however, it is satisfactory enough to provide annealed wire with clean finishes which entail the removal of lubricants therefrom and the avoidance of significant soot deposition thereon.

In a typical cycle for annealing ferrous wire, the latter is introduced into a bell or batch furnace in known manner and is subjected to a temperature profile in which the furnace is heated to a temperature, typically of about 1000°-1100° F. which is held for an hour or so. The furnace temperature is then increased to approximately 1320° F. under which the wire is "soaked" for several hours before the load is cooled, eventually down to a temperature of about 850°-900° F. at which point the annealed wire is removed. Typically, approximately 10-12 hours will be required for soaking to effectively anneal a load of ferrous wire.

For purposes of understanding the present invention, references hereafter to a "furnace" will be understood to mean the inner retort of a bell furnace and/or the hot zone of a batch furnace. The flow of nitrogen is continued during heat build up at a relatively high rate with exhaust valves of the furnace open to assure that contaminants such a moisture, $CO_2$, ambient oxygen are effectively removed from the furnace. This purging of the furnace is required to avoid significant decarburization and/or oxidation of the ferrous wire which can result if such contaminants are present at annealing temperatures. Subsequently, after the annealing temperatures are reached in the furnace, the nitrogen flow rate may be reduced, typically by 50% or so, as the high flow rate is no longer necessary to simply maintain a purged condition. The flow of nitrogen to the furnace will continue in accordance with the invention until an oxygen containing gas is introduced therein as will be subsequently described.

Upon the furnace reaching a temperature of approximately 1000° F., a hydrocarbon such a methane, propane, etc. is introduced into the furnace at a desired flow rate for the purpose of reacting with oxidants that may remain. Upon the furnace reaching an annealing temperature of about 1320° F., the flow rate of hydrocarbon may be also reduced, typically to about one-half the initial flow rate. A lower flow rate of hydrocarbon additives will generally be sufficient to react with substantially all of such oxidants and thereby maintain non-decarburizing and non-oxidizing conditions. The flow of hydrocarbon additive may be terminated well before termination of the flow of nitrogen. In addition, other suitable additives such as methanol, etc. which break down to form hydrogen and carbon monoxide may be introduced into the furnace if desired.

It will be understood that during slow cooling of the furnace, carbon monoxide tends to decompose as the same is cooled through a critical range below approximately 1100° F. This decomposition of carbon monoxide leads to the formation of free carbon or soot and carbon dioxide and is a significant cause of soot formation during annealing.

Subsequent to termination of the flow of hydrocarbon additive to the furnace, nitrogen flow is continued as shown in the drawing preferably for a duration sufficient to result in at least four inner furnace volume changes (the volume under an inner cover of a bell furnace or of the hot zone of a batch furnace). At this point in the process, the soak period is ending and the cooling stage begins. The duration of nitrogen flow prior to introduction of oxygen containing gas is generally illustrated by arrow A of the drawing. This particular duration of nitrogen flow will assure that the concentration of combustibles in the furnace is essentially negligible and preferably below 0.10%. Upon the wire temperature decreasing during the cooling stage to approximately 1050° F. and preferably to about 1000° F., a flow of oxygen containing gas is introduced therein. The oxygen containing gas may comprise air or a mixture of 20% oxygen and 80% nitrogen. Preferably, this gas has been filtered to avoid introduction of oil vapors, etc. into the furnace. Although it is preferable to introduce such oxygen containing gas when the wire temperature is 1000° F. or slightly lower, if it can be assured that the temperature distribution in the furnace is known precisely, the oxygen containing gas may be introduced into the furnace at wire temperatures approaching 1100° F. It is important that the oxygen containing gas not be introduced at temperatures above 1100° F. as this will result in decarburization of the ferrous wire being annealed. However, as it is difficult to predict temperature distributions throughout furnaces as the same may vary with the condition and age of one furnace as compared to another, it is preferred to introduce oxygen containing gas when the measured wire temperature is below 1050° F. which is generally sufficient to assure that no portion of the ferrous wire being annealed is at a temperature of 1100° F. or greater. Thus, it is desirable to introduce the oxygen containing gas when the wire temperature reaches and continues to fall below 1000° F. Furthermore, it has also been found that at temperatures below 950° F., the addition of oxygen containing gas into the furnace is relatively ineffective to react with lubricants on the wire but will continue to contribute to oxidation. Therefore, in accordance with the invention, it is preferred to introduce the aforementioned oxygen containing gas into the furnace under wire temperature conditions of approximately 1050°–950° F. Finally, it will be understood that the rate and duration of introduction of the oxygen containing gas will be sufficient to assure that non-explosive conditions are maintained in the furnace, i.e. that oxygen/hydrocarbon levels are well within safety limits.

In annealing ferrous wire in a bell furnace, the oxygen containing gas may be introduced in the form of air by lifting the inner cover in a known manner by approximately 2–3 feet for a time of approximately 3–5 minutes following which the inner cover is replaced. Alternatively, air may be injected into the inner retort of a bell furnace or directly into a batch furnace. Typically, air is injected into a batch furnace for about 10–30 minutes at a flow rate of about 0.5–2.0 inner volume changes per hour. The flow of air is then terminated. The introduction of an oxygen containing gas is generally depicted in the attached drawing as occurring for a relatively brief portion of the complete annealing cycle at the temperatures described hereinabove.

In accordance with the invention, a typical cooling procedure may be utilized to assure lubricant removal and substantially preclude soot formation on ferrous wire. As depicted in the sole FIGURE of the drawing at the end of the soaking period, i.e. a wire temperature of approximately 1320° F., the flow of hydrocarbon is terminated and the ferrous wire load is permitted to commence cooling. When the wire temperature in a bell furnace has fallen to approximately 1000° F., the water and oil seals and water for rubber seals typically provided therewith are turned off as are any fans in the furnace. The flow of nitrogen, which will have been at least four inner volume changes of the furnace following termination of the hydrocarbon flow, will also be terminated, and the inner cover of the furnace is raised approximately 2–3 feet above its base for about 3–5 minutes. Following this latter time period, the inner cover is replaced on its base and water and oil seals are turned on as are furnace fans. It is not necessary to recommence the flow of nitrogen to the furnace which is permitted to cool until a temperature of about 850° F. is reached at which point the inner cover of the furnace may be removed and the ferrous wire load may be removed therefrom. As mentioned previously, the flow rate at which the oxygen containing gas is introduced into the furnace is adjusted so that safe operating conditions are maintained therein and potentially explosive conditions are avoided.

Finally, although the present invention has been described with respect to the annealing of ferrous or steel wire, it is understood that other ferrous materials such as rod, etc. may be annealed as well.

The foregoing and other various changes in form and details may be made without departing from the spirit and scope of the present invention. Consequently, it is intended that the appended claims be interpreted as including all such changes and modifications.

We claim:

1. A method of annealing ferrous wire bearing lubricants under a nitrogen based atmosphere in a furnace comprising the steps of heating said wire to a soaking temperature of about 1320° F., subsequently cooling said wire in said furnace; and introducing an oxygen containing gas into the furnace and into contact with said wire when the wire temperature has declined to about 1050°–950° F. such that oxygen is reacted with residual lubricants and soot deposits without significant decarburization of said wire.

2. The method defined in claim 1 wherein said oxygen-containing gas contacts said wire when the temperature thereof has cooled to about 1000° F. to 950° F.

3. The method defined in claim 1 wherein said oxygen-containing gas is air.

4. The method defined in claim 3 wherein said furnace is a bell furnace having an inner cover under which said wire is annealed and said step of introducing air comprises raising said inner cover.

5. The method defined in claim 4 wherein said step of raising said cover comprises raising the same to a height of about 2–3 feet for about 3–5 minutes.

6. The method defined in claim 3 wherein said furnace is a bell furnace having an inner cover and said step of introducing air comprises injecting air directly under said inner cover at a flow rate of about 0.5 to 2.0 inner volume changes per hour.

7. The method defined in claim 3 wherein said furnace is a batch furnace having a hot zone in which said wire is annealed and said step of introducing air comprises injecting air directly into said batch furnace.

8. The method defined in claim 7 wherein said step of injecting air comprises injecting air at a flow rate of between about 0.5 to 2.0 inner volume changes per hour.

9. The method defined in claim 3 additionally comprising the steps of introducing a hydrocarbon into said furnace, introducing a flow of nitrogen gas into said furnace, terminating said hydrocarbon flow, and continuing said nitrogen gas flow thereafter at a flow rate and duration such that at least 4 inner furnace volume changes are effected prior to introducing said air into the furnace.

* * * * *